US008597085B2

(12) United States Patent
Rudolf

(10) Patent No.: US 8,597,085 B2
(45) Date of Patent: Dec. 3, 2013

(54) FULL PROFILE DRESSING ROLL FOR DRESSING MULTI-START CYLINDRICAL GRINDING WORMS

(75) Inventor: Christoph Rudolf, Dietilikon (CH)

(73) Assignee: Reishauer AG, Wallisellen (CH)

( * ) Notice: Subject to any disclaimer, the term of this patent is extended or adjusted under 35 U.S.C. 154(b) by 438 days.

(21) Appl. No.: 12/971,699

(22) Filed: Dec. 17, 2010

(65) Prior Publication Data

US 2011/0151756 A1 Jun. 23, 2011

(30) Foreign Application Priority Data

Dec. 17, 2009 (DE) ..... 10 2009 059 201

(51) Int. Cl.
*B24B 21/18* (2006.01)

(52) U.S. Cl.
USPC ..... 451/443; 451/56; 451/47; 451/547; 125/11.03; 125/11.04

(58) Field of Classification Search
USPC ..... 451/56, 443, 541, 547, 47, 5, 72; 125/11.03, 11.04
See application file for complete search history.

(56) References Cited

U.S. PATENT DOCUMENTS

| | | | | |
|---|---|---|---|---|
| 1,702,160 | A * | 2/1929 | Hanson | 451/47 |
| 3,602,209 | A * | 8/1971 | Bocker | 125/11.03 |
| 4,548,000 | A * | 10/1985 | Junker | 451/48 |
| 6,379,217 | B1 * | 4/2002 | Thyssen | 451/5 |
| 7,121,930 | B2 * | 10/2006 | Thyssen | 451/56 |
| 7,294,046 | B2 * | 11/2007 | Turich et al. | 451/56 |
| 8,113,915 | B2 * | 2/2012 | Jankowski et al. | 451/47 |
| 8,147,296 | B2 * | 4/2012 | Lopez | 451/56 |
| 2003/0027507 | A1 * | 2/2003 | Stollberg | 451/72 |
| 2004/0235401 | A1 * | 11/2004 | Schauer | 451/72 |
| 2005/0245176 | A1 * | 11/2005 | Thyssen | 451/56 |
| 2006/0025050 | A1 * | 2/2006 | Yanase et al. | 451/5 |

FOREIGN PATENT DOCUMENTS

| | | | |
|---|---|---|---|
| CH | 684.249 | A5 | 8/1994 |
| DE | 3308107 | A1 | 9/1984 |
| DE | 3503914 | A1 | 8/1986 |
| DE | 19849259 | C1 | 7/2000 |
| DE | 102004020947 | A1 | 11/2005 |
| JP | 2005-271127 | | 10/2005 |
| JP | 2005-313320 | | 11/2005 |

OTHER PUBLICATIONS

Korean Office Action mailed Feb. 12, 2013, from corresponding Korean application, with translation.

* cited by examiner

*Primary Examiner* — George Nguyen
(74) *Attorney, Agent, or Firm* — Browdy and Neimark, PLLC

(57) ABSTRACT

Full profile dressing roll (1) for dressing multi-start grinding worms for the generation grinding of small-module gears, comprising a groove-shaped axial section profile of the outer envelope surface (2), covered with hard material grains, and profile-cut hard-material profile combs (3) embedded in this envelope surface and having a multi-ribbed rack tooth system profile, the profile of which touches the outer envelope surface (2) of the dressing roll (1) only in sections of the axial section profile of the dressing roll (1) which do not participate in the generation of the grinding worm flanks. As a result, the profile sections, highly stressed during the dressing, at the crest and root of the profile grooves (4) are protected from high wear and premature grain loss and the service life of the dressing roll is effectively increased without the inhomogeneity of the flank surface of the dressing roll (1) being disturbed by the profile combs (3).

20 Claims, 2 Drawing Sheets

FULL PROFILE DRESSING ROLL FOR DRESSING MULTI-START CYLINDRICAL GRINDING WORMS

TECHNICAL FIELD

The present invention relates to a dressing roll for dressing a multi-start cylindrical grinding worm for the grinding of small-module gears by the continuous generation grinding process. The thread profile of the grinding worm is produced by reproducing the groove profile of the dressing roll on the circumference of the grinding worm.

PRIOR ART

Dressable cylindrical grinding worms having a ceramic bond are used in particular in the final hard machining of tooth flanks within the module range of below 2 mm in the continuous generation grinding process, said grinding worms having eight or even more starts, depending on the module and the number of teeth of the workpiece to be ground. Such grinding worms are often dressed by means of "full profile dressing rolls" having profile grooves which are coated with hard material grains on their outer envelope surface active during the dressing and enclose the grinding worm thread profile, to be dressed, of some starts or of preferably all the starts. As a result, a high accuracy, short dressing times and therefore an efficient dressing process can be achieved.

Figure 1:
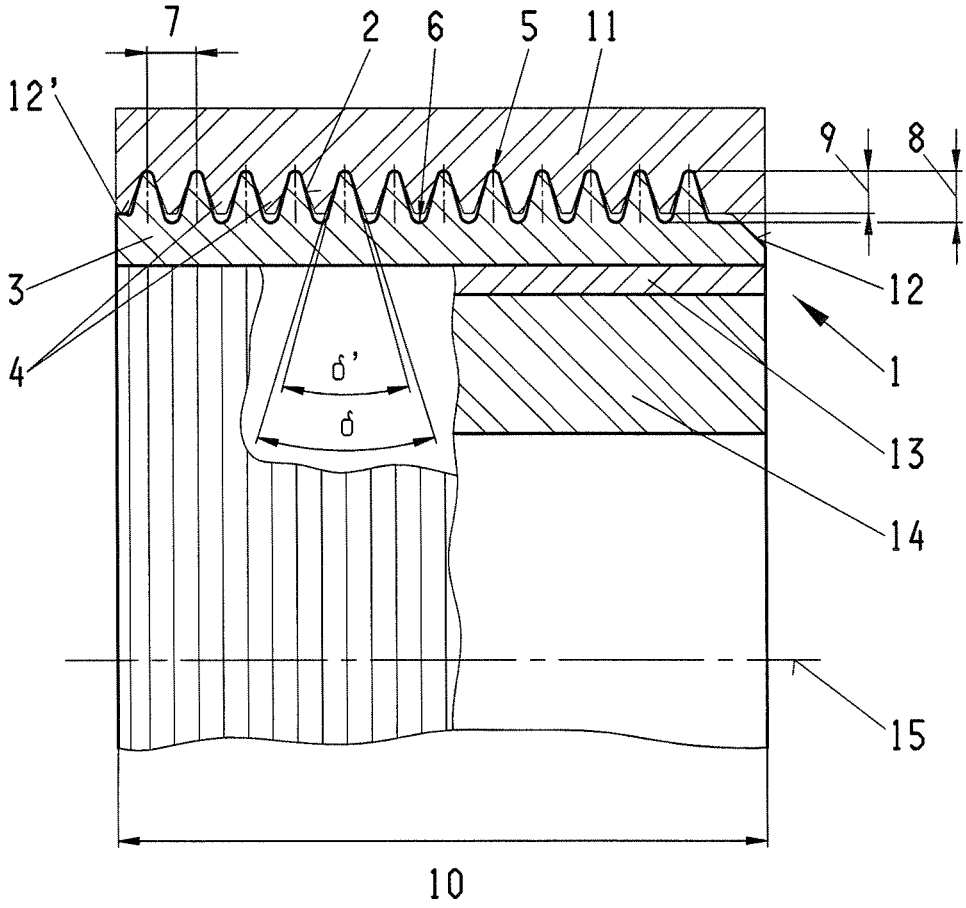

Such a tool is known, for example, from DE 10 2004 020 947 A1, wherein a full profile dressing roll coated with hard material grains is schematically shown in FIG. 1 in engagement with a two-start grinding worm.

The configuration and method of using full profile dressing rolls for the dressing or calibrating of cylindrical grinding worms for the grinding of the tooth flanks of small-module gears are described in detail, and therefore this needs not be dealt with in any more detail.

As mentioned in DE 10 2004 020 947 A1, these full profile dressing rolls have the disadvantage that it has not been possible to this day to technically re-work the hard material coating for correcting the flank geometry and for ensuring an adequate surface quality of the ground gears. For that reason, said full profile dressing rolls have to be produced according to the known time-consuming negative process. The principle of the negative or reversal process is known, for example, from DE 33 08 107 and CH 684249.

A further known disadvantage of these full profile dressing rolls consists in the fact that hard material grains located circumferentially at the tip and at the root of the groove profile are subjected to higher loading during the generation of the grinding worm thread by radial feeding in of the dressing roll and are therefore subjected to greater wear than the grains on the flanks of the groove profile. In addition, the hard material grains located at the tip of the grooves are anchored in the metal bond to a lesser extent for geometrical reasons. The result of both effects is that the hard material grains located at the tip of the profile grooves are at a greater risk of premature grain break-out and the service life of the dressing tool ends, due to grain break-out, at a time when the remaining grains of the dressing coating are still in a state capable of cutting. As a result, a large proportion of the performance capacity of the costly tool is wasted unused.

In order to avoid the premature blunting and grain break-out in the regions subjected to higher stress, in particular in the tip region of such dressing tools, it is attempted to strengthen these regions by special measures. In DE 198 49 259, this is done, for example in a dressing disc, by means of specially fastened elongated diamonds specifically set in the outer circumferential zone. However, on account of the considerable amount of work involved and the restricted accessibility, this measure is unsuitable for multi-grooved dressing rolls.

A profiled dressing tool for rotating grinding bodies is proposed in DE 3503914 A1, the active surface of which dressing tool is formed from hard material grains and in which profiled hard segments of profile-cut synthetic diamond are embedded in the active surface, said segments lying with their profile in the envelope surface of the outermost cutting edges of the hard material grains and extending with sections of their profile beyond the envelope surface of the outermost edges of the hard material grains. Two or more segments are arranged next to one another in their longitudinal direction with a gap in between and segments lying in front of or behind said segments in the direction of movement are arranged offset in an overlapping manner.

A dressing tool provided with hard segments in this way has a longer service life than a dressing tool covered only with hard material grains. The hard material grains forming the active surface of the dressing tool are protected from wear and break-out. A known disadvantage, however, is that the grinding wheel surface to be dressed is at the same time, or even mainly, dressed by the profiled segments of profile-cut synthetic diamond. Owing to the fact that the cutting edges of the hard segments lie in the envelope surface of the outermost edges of the hard material grains, inhomogeneity arises on the working surface of the dressing tool and is reproduced as inhomogeneity on the dressed surface of the grinding tool, and this inhomogeneity can impair the quality of the ground workpiece. This is particularly the case when grinding tooth flanks, during which even the smallest periodically occurring changes in shape and structure on the ground tooth flank surface can lead to noise problems and therefore have to be avoided. In addition, during the generation of the thread profile of a multi-start grinding worm, the pitch accuracy of the generated grinding worm profile would be put at risk by inaccuracies during the positioning of a plurality of profiled hard material segments arranged axially in a row and offset from one another. For these reasons, a dressing tool according to DE 3503914 A1 is not suitable for the dressing of multi-start grinding worms, as are used for grinding small-module gears.

DESCRIPTION OF THE INVENTION

The object of the present invention is to propose a full profile dressing roll for dressing multi-start grinding worms for the generation grinding of small-module gears, comprising a groove-shaped axial section profile of the outer envelope surface, covered with hard material grains, and profile-cut hard material segments embedded in this envelope surface, in which full profile dressing roll the disadvantages of the known solutions for strengthening highly stressed profile regions are avoided. This object is achieved by a dressing tool having the features of claim 1. Embodiments of the invention are the subject matter of the dependent claims.

According to an embodiment of the invention, the hard material segments embedded in the outer envelope surface of the full profile roll are 0.15 to 3 mm thick profile combs, profile-cut with high precision and made of synthetic diamond or another suitable hard material that can be machined with high precision, or a suitable base material coated with hard material, having a multi-ribbed rack tooth profile, the length of which extends in the direction of the rotation axis of the dressing roll over the entire width thereof and the tooth pitch of which exactly matches that of the full profile roll.

As already mentioned, the coating of the flanks of the groove profile of the profile dressing roll with hard material grains must not be interrupted by profiled hard material segments touching the outer envelope surface of the groove profile, because this would put at risk the homogeneity of the grinding worm flanks and thus the quality of the ground pattern on the tooth flanks of the gear to be ground. For that reason, the profile of the tooth combs is preferably designed in such a way that the profile combs embedded in the outer envelope surface of the profile dressing roll touch said envelope surface only in profile regions which do not participate in the generation of the workpiece tooth flanks. These are the tip region, which is subjected to especially high stress during the dressing and is therefore at risk of wear and grain break-out, and also, if necessary, the root region of the groove profile of the dressing roll, which is less at risk, wherein the profile of the profile comb does not project from the outer envelope surface of the groove profile in any profile section.

This is achieved according to an embodiment of the invention in that the profile of the profile combs, although exactly matching the groove profile of the dressing roll in the crest region and if need be in the root region, is set back by a percentage of 10 to 40% of the size of the hard material grains in the region of the flanks of the profile grooves of the dressing roll. This is achieved, for example, by a flank angle of the profile combs which is slightly reduced compared with the flank angle of the groove profile of the dressing roll, or by the cutting edges of the profile combs being set back in another way in the form of a reduced profile width in the region of the flanks.

According to an embodiment of the invention, a plurality of profile combs are arranged in a distributed manner at uniform or non-uniform distances apart over the circumference of the dressing roll. The full profile roll is preferably produced according to the known negative process by metal deposition as a bonding agent of the hard material grains and profile combs in a negative mould which has an inner surface of a shape complementary to the outer envelope surface of the dressing roll. The profile combs are exactly positioned in the negative mould by means of accurately produced bearing surfaces.

WAYS OF IMPLEMENTING THE INVENTION

Figure 2A:
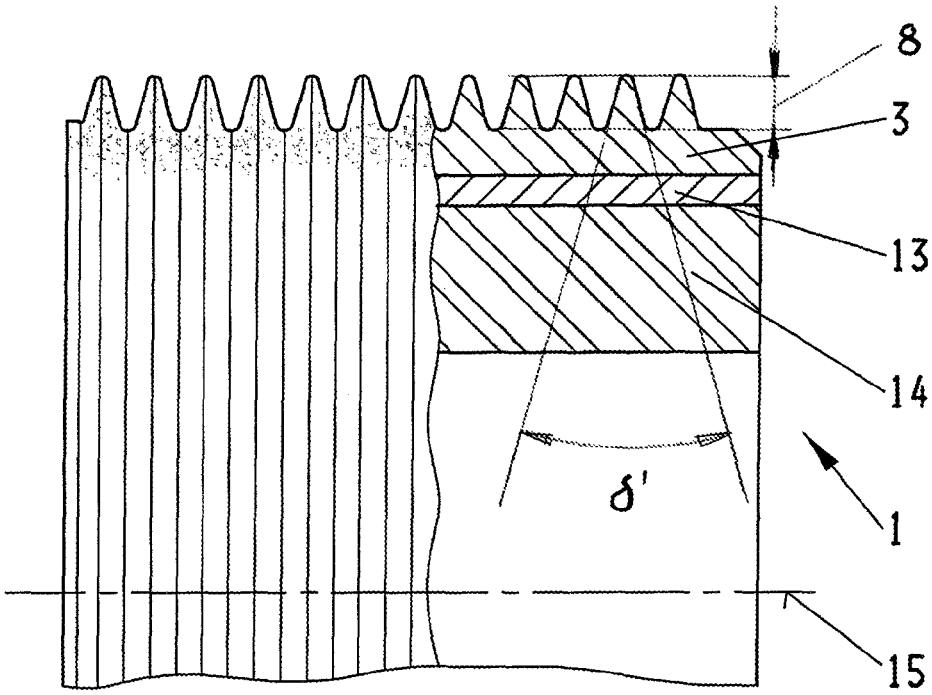
Figure 2B:
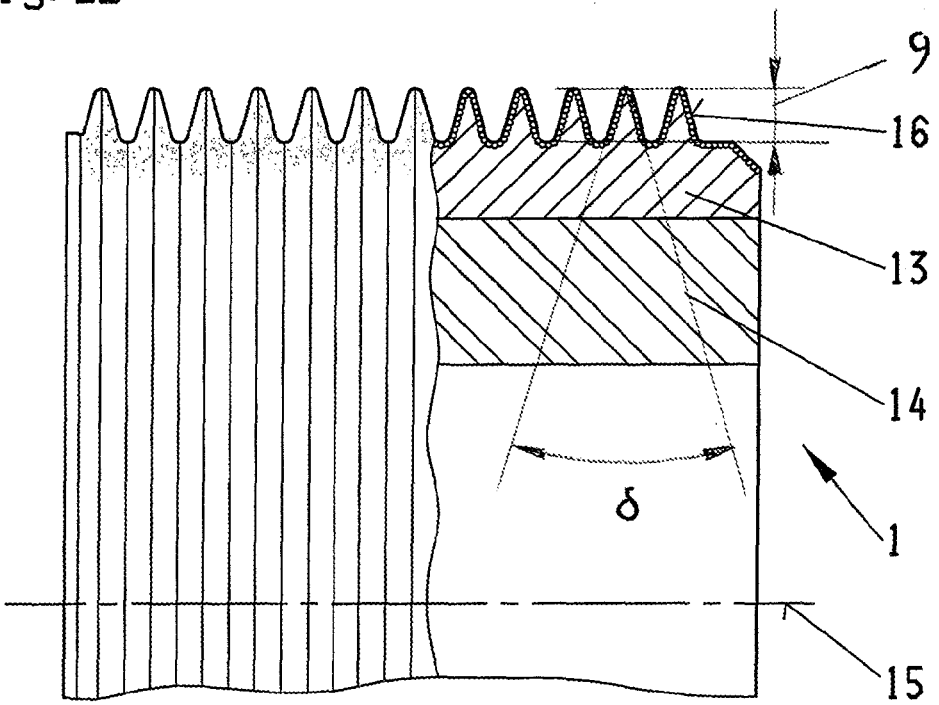

The invention is explained in more detail below with reference to a preferred exemplary embodiment and with the aid of the drawings, in which:

FIG. 1 schematically shows an axial section of a full profile dressing roll according to the invention in the production stage before the removal of the negative mould, FIG. 2*a* schematically shows the axial section of the full profile dressing roll according to the invention in accordance with FIG. 1, the negative mould being removed, and FIG. 2*b* shows an axial section of the full profile roll in an axial section plane without profile comb, in which the hard material grains can be seen.

The exemplary embodiment selected here concerns a case in which the profile comb 3 inserted into the negative mould 11 and shown in longitudinal section touches the outer envelope surface 2, predetermined by the negative mould 11 of the dressing roll 1, only in the rounded tip portion 5. At the groove flanks and in the root region of the dressing roll 1, the profile contour of the dressing comb 3 is set back inwards relative to the outer envelope surface 2 of the dressing roll in order to prevent the contact thereof with the flanks and the tip region of the grinding worm during the dressing and calibrating of the grinding worm thread. This is achieved in the case shown here by a flank angle δ' of the profile combs 3 which is slightly reduced relative to the flank angle δ of the groove profile 2 of the dressing roll 1.

The groove pitch 7 of the profile combs 3 exactly matches the profile pitch of the outer envelope surface 2 of the dressing roll 1, consisting of hard material grains 16. By means of bearing surfaces 12, 12', produced with high accuracy on the outer ends of the profile combs 3, said profile combs 3, before they are bonded in the electrodeposited metal bond 13, are exactly positioned radially and axially and are fixed by means of an adhesive. The hard material grains 16 bearing in a known manner on the inner surface of the negative mould cannot be seen in FIG. 1. The negative mould 11 is removed after the internal cylindrical turning of the metal bond 13 concentrically to the rotation axis 15 of the dressing roll 1 and after the insertion and internal cylindrical grinding of the basic body 14. FIG. 2*a* shows the full profile dressing roll 1 after the removal of the negative mould 11 in the same axial section plane as in FIG. 1. Shown in FIG. 2*b* is the axial section of the full profile dressing roll 1 in an axial section plane in which there is no profile comb 3. The coating of the profile grooves 4 of the full profile dressing roll 1, consisting of hard material grains 16, can be seen here.

In FIGS. 2*a* and 2*b*, reference numeral 8 designates the profile height of the profile combs, reference numeral 9 designates the profile height of the groove profile defined by the metal bond 13 with the coating of hard material grains 16, symbol δ' designates the flank angle of the profile combs, and symbol δ designates the flank angle of the groove profile defined by the metal bond 13 with the coating of hard material grains 16.

The full profile dressing roll 1 has profile-cut hard material segments. Said segments form the profile combs 3, which have a multi-ribbed rack tooth profile. The profile of the profile combs 3 touches the outer envelope surface 2 of the dressing roll 1 only in selected sections of the axial section profile of the dressing roll 1. The profile does not project therefrom in any profile section.

LIST OF DESIGNATIONS

1 Dressing roll
2 Outer envelope surface of the dressing roll
3 Profile comb
4 Profile grooves
5 Rounded tip portion
6 Root radius
7 Groove pitch
8 Profile height of the profile combs
9 Profile height of the dressing roll
10 Width of the dressing roll
11 Negative mould
12, 12' Bearing surfaces
13 Metal bond
14 Basic body
15 Rotation axis of the dressing roll
16 Hard material grains
δ Flank angle of the groove profile
δ' Flank angle of the profile combs

The invention claimed is:

1. A full profile dressing roll for dressing multi-start grinding worms for the generation grinding of small-module gears, the dressing roll having a central longitudinal axis, the dressing roll comprising:

a carrier;

a coating of hard material grains on the carrier, the coating defining an outer envelope surface of the dressing roll, the outer envelope surface having a groove-shaped profile when viewed in a section along the longitudinal axis, the grooves extending in a circumferential direction perpendicular to the longitudinal axis, the outer envelope surface, in the region of the grooves, having tip portions and root portions, the tip portions and root portions being connected by flank portions; and profile combs made of a profile-cut hard material, the profile combs being embedded in the carrier, each profile comb extending longitudinally and interrupting the coating in a circumferential direction, each profile comb having a multi-ribbed rack tooth profile when viewed in a section along the longitudinal axis, the rack tooth profile touching only selected portions of the outer envelope surface while being set back from at least the flank portions of the outer envelope surface.

2. The full profile dressing roll according to claim 1, wherein the rack tooth profile of the profile combs exactly matches the outer envelope surface in those selected regions where the rack tooth profile touches the outer envelope surface.

3. The full profile dressing roll according to claim 1, wherein the rack tooth profile of the profile combs touches the tip portions of the outer envelope surface is while being set back both from the root portions and the flank portions of the outer envelope surface.

4. The full profile dressing roll according to claim 1, wherein the rack tooth profile of the profile combs touches both the tip portions and the root portions while being set back from the flank portions of the outer envelope surface.

5. The full profile dressing roll according to claim 1, wherein the profile combs have a first groove pitch, wherein the carrier with the coating has a second groove pitch, and wherein the first groove pitch exactly matches the second groove pitch.

6. The full profile dressing roll according to claim 1, wherein the profile combs have a first profile height, wherein the carrier with the coating has a second profile height, and wherein the first profile height is the same as or larger than the second profile height.

7. The full profile dressing roll according to claim 1, wherein the hard material grains have a size, and wherein the rack tooth profile of the profile combs is set back from the flank portions of the outer envelope surface by a percentage of 10 to 40% of the size of the hard material grains.

8. The full profile dressing roll according to claim 1, wherein the profile combs define a first flank angle (δ'), wherein the carrier with the coating defines a second flank angle (δ), and wherein the first flank angle is smaller than the second flank angle.

9. The full profile dressing roll according to claim 1, wherein the dressing roll has a length along the longitudinal direction, and wherein the profile combs extend over the entire length of the dressing roll in a direction parallel to the longitudinal axis of the dressing roll.

10. The full profile dressing roll according to claim 1, wherein the profile combs are arranged in a distributed manner at uniform or non-uniform distances over the circumference of the dressing roll.

11. The full profile dressing roll according to claim 1, wherein the profile combs consist of profile-cut synthetic diamond.

12. The full profile dressing roll according to claim 1, wherein the carrier is produced by metal deposition in a negative mould by a negative process, said negative mould having an inner surface of a shape complementary to the outer envelope surface of the dressing roll.

13. The full profile dressing roll according to claim 12, wherein the profile combs have, at their ends, bearing surfaces which ensure their exact radial and axial positioning in the negative mould.

14. The full profile dressing roll according to claim 1, wherein the carrier comprises a metal bond, and wherein the profile combs are embedded in the metal bond.

15. The full profile dressing roll according to claim 1, wherein the carrier has a tubular shape, and the dressing roll further comprises a basic body arranged concentrically inside the carrier.

16. The full profile dressing roll according to claim 3, wherein the rack tooth profile of the profile combs exactly matches the tip portions of the outer envelope surface.

17. The full profile dressing roll according to claim 4, wherein the rack tooth profile of the profile combs exactly matches the tip portions and the root portions of the outer envelope surface.

18. The full profile dressing roll according to claim 1, wherein the tip portions of the outer envelope surface are rounded.

19. A full profile dressing roll for dressing multi-start grinding worms for the generation grinding of small-module gears, the dressing roll having a central longitudinal axis, the dressing roll comprising:

a carrier;

a coating of hard material grains on the carrier, the coating defining an outer envelope surface of the dressing roll, the outer envelope surface having a groove-shaped profile when viewed in a section along the longitudinal axis, the grooves extending in a circumferential direction perpendicular to the longitudinal axis; and profile combs made of a profile-cut hard material, the profile combs being embedded in the carrier, each profile comb extending longitudinally and interrupting the coating in a circumferential direction, each profile comb having a multi-ribbed rack tooth profile when viewed in a section along the longitudinal axis, the rack tooth profile touching only selected portions of the outer envelope surface while not projecting from the outer envelope surface anywhere, the profile combs defining a first flank angle (δ'), the carrier with the coating defining a second flank angle (δ), wherein the first flank angle is smaller than the second flank angle.

20. A full profile dressing roll for dressing multi-start grinding worms for the generation grinding of small-module gears, the dressing roll having a central longitudinal axis, the dressing roll comprising:

a carrier;

a coating of hard material grains on the carrier, the coating defining an outer envelope surface of the dressing roll, the outer envelope surface having a groove-shaped profile when viewed in a section along the longitudinal axis, the grooves extending in a circumferential direction perpendicular to the longitudinal axis; and profile combs made of a profile-cut hard material, the profile combs being embedded in the carrier, each profile comb extending longitudinally and interrupting the coating in a circumferential direction, each profile comb having a multi-ribbed rack tooth profile when viewed in a section along the longitudinal axis, the rack tooth profile touching only selected portions of the outer envelope surface while not projecting from the outer envelope surface anywhere, wherein the dressing roll has a length along the longitudinal axis, and wherein the profile combs extend over the entire length of the dressing roll in a direction parallel to the longitudinal axis of the dressing roll.

* * * * *